US007846215B2

(12) United States Patent
Weber et al.

(10) Patent No.: US 7,846,215 B2
(45) Date of Patent: Dec. 7, 2010

(54) PROCESS FOR DYEING POLYESTER

(75) Inventors: Martin Weber, Steinen (DE); Edvard Ham, Riehen (CH)

(73) Assignee: Huntsman International LLC, The Woodlands, TX (US)

( * ) Notice: Subject to any disclaimer, the term of this patent is extended or adjusted under 35 U.S.C. 154(b) by 117 days.

(21) Appl. No.: 12/279,446

(22) PCT Filed: Feb. 1, 2007

(86) PCT No.: PCT/EP2007/050979

§ 371 (c)(1),
(2), (4) Date: Aug. 14, 2008

(87) PCT Pub. No.: WO2007/093505

PCT Pub. Date: Aug. 23, 2007

(65) Prior Publication Data

US 2009/0119853 A1 May 14, 2009

(30) Foreign Application Priority Data

Feb. 17, 2006 (EP) ..... 06110079

(51) Int. Cl.
*C09B 67/38* (2006.01)

(52) U.S. Cl. ..... 8/592; 8/922; 8/609; 8/636; 8/639; 8/116.1; 8/115.7; 8/918

(58) Field of Classification Search ..... 8/922, 8/592, 609, 636, 639, 641, 587, 494, 115.6, 8/116.1, 115.7, 918
See application file for complete search history.

(56) References Cited

U.S. PATENT DOCUMENTS

| | | | | |
|---|---|---|---|---|
| 4,252,532 | A * | 2/1981 | Engelhardt et al. | 8/557 |
| 6,730,132 | B1 * | 5/2004 | Beckmann et al. | 8/137 |
| 7,396,370 | B2 | 7/2008 | Gruner et al. | |
| 2002/0151235 | A1 * | 10/2002 | Bartl et al. | 442/60 |

FOREIGN PATENT DOCUMENTS

| | | | |
|---|---|---|---|
| DE | 19629453 | | 1/1998 |
| DE | 10346944 | * | 5/2005 |
| DE | 10356336 | | 6/2005 |

OTHER PUBLICATIONS

Translation of abstract and document of DE 10346944 by esp@cenet Mar. 10, 2010.*

* cited by examiner

*Primary Examiner*—Gregory R Del Cotto
*Assistant Examiner*—Amina Khan

(57) ABSTRACT

The invention relates to a process for dyeing polyester fibre material according to the exhaust method, which process comprises the following steps:

(a) pre-treatment of the fibre material with one or more surfactants, (b) dyeing with one or more disperse dyes, and (c) reductive after-treatment with a hydroxyalkylsulfinic acid or a hydroxyalkylsulfinic acid salt, wherein steps (a), (b) and (c) are carried out in succession in a single liquor.

6 Claims, No Drawings

PROCESS FOR DYEING POLYESTER

CROSS REFERENCE TO RELATED APPLICATIONS

This application is the National Phase of International Application PCT/EP2007/050979 filed Feb. 1, 2007 which designated the U.S. and which claims priority to European Patent Application (EP) 06110079.8 filed Feb. 17, 2006. The noted applications are incorporated herein by reference.

The present invention relates to a process for dyeing polyester fibre material using dispersion dyes according to the exhaust method.

The conventional procedure for dyeing fibre materials of polyester (PES) in the form of yarns or flat textile structures, for example woven fabrics, generally consists of at least three separate process steps. In a pre-treatment step the fibre material is, for the purpose of degreasing/cleaning, treated with a surfactant-containing washing liquor that may also contain further auxiliaries, such as desizing agents or bleaching agents. In the second step, the dyeing procedure itself, the polyester fibres are subjected to treatment with a dye dispersion at elevated temperature in the acid pH range. In order to enhance the fastness properties, particles of dye adhering to the surface of fibre materials dyed in that manner are removed by a reductive after-treatment in the alkaline pH range. The dyed goods are then neutralised so that the end products have a neutral to slightly acidic pH.

That multi-step process, which also requires three different cleaning and dyeing liquors, is relatively time-consuming and is associated with an appreciable amount of liquid waste charged with pollutants.

There is accordingly a need for a more efficient, time-saving and simultaneously more environmentally friendly process for dyeing polyester fibre material.

It has now, surprisingly, been found that the above-described multi-step procedure can be simplified considerably and carried out as a so-called "all-in-one" procedure in a single liquor by carrying out the pre-wash in the dye bath and carrying out the reductive after-treatment, using a specific reducing agent, at acid pH in the same bath.

The present invention relates to a process for dyeing polyester fibre material according to the exhaust method, which process comprises the following steps:

(a) pre-treatment of the fibre material with one or more surfactants, (b) dyeing with one or more disperse dyes, and (c) reductive after-treatment with a hydroxyalkylsulfinic acid or a hydroxyalkylsulfinic acid salt, wherein steps (a), (b) and (c) are carried out in succession in a single liquor.

The process according to the invention is suitable for dyeing fibre materials based on synthetic polyesters, it being possible for both pure polyesters and PES blend fabrics to be used.

Preference is given to linear aromatic polyesters, which can be obtained by poly-condensation of terephthalic acid and glycols or terephthalic acid and 1,4-bis(hydroxymethyl) cyclohexane, such as, for example, polyethylene terephthalate (PET) or polybutylene terephthalate (PBTP).

The surfactants suitable for cleaning and/or degreasing in process step (a) are known to the person skilled in the art and are, for the most part, available commercially.

In process step (a), preference is given to the use of a non-ionic surfactant or an anionic surfactant. Non-ionic surfactants are especially preferred.

Suitable non-ionic surfactants are especially compounds containing oxyalkylene groups, especially oxyethylene groups, such as, for example, fatty alcohol polyglycol ethers (fatty alcohol ethoxylates), alkylphenol polyglycol ethers, fatty acid ethoxylates, fatty amine ethoxylates, ethoxylated triglycerides and monoalkylated polyethylene glycol ethers as well as polyethylene glycol ethers alkylated at both ends.

In general, fatty alcohol polyglycol ethers are addition products of from 2 to 20 mol of alkylene oxide, especially ethylene oxide, with 1 mol of a saturated or unsaturated monoalcohol having from 8 to 22 carbon atoms.

Aliphatic saturated monoalcohols that come into consideration include natural alcohols, e.g. lauryl alcohol, myristyl alcohol, cetyl alcohol or stearyl alcohol, and also synthetic alcohols, e.g. 2-ethylhexanol, 1,1,3,3-tetramethylbutanol, octan-2-ol, isononyl alcohol, trimethylhexanol, trimethylnonyl alcohol, decanol, $C_9$-$C_{11}$oxo-alcohol, tridecyl alcohol or isotridecanol. Unsaturated aliphatic monoalcohols are, for example, dodecenyl alcohol, hexanedecenyl alcohol or oleyl alcohol.

Suitable fatty alcohol polyglycol ethers are also alkylene oxide adducts of mixtures of two or more alcohols, for example mixtures of alcohols derived from soybean fatty acids, palm kernel fatty acids or tallow oils.

Suitable alkylphenol polyglycol ethers are addition products of from 2 to 20 mol of alkylene oxide, especially ethylene oxide, with 1 mol of an alkylphenol. Examples thereof are ethoxylated 4-(1,1,3,3-tetramethylbutyl)phenol, ethoxylated 4-(1,3,5-trimethylhexyl)phenol, ethoxylated 4-dodecylphenol, ethoxylated 2,4-bis(1,3,5-trimethylhexyl)phenol and ethoxylated 2,4,6-tributylphenol.

Fatty acid ethoxylates, fatty amine ethoxylates and ethoxylated triglycerides are addition products of from 2 to 20 mol of alkylene oxide, especially ethylene oxide, with 1 mol of a fatty acid, of a fatty amine or of a triglyceride, respectively.

Instead of using hydroxy-terminated polyglycol ethers in process step (a), it is also possible to use phosphated derivatives thereof, that is, the corresponding phosphoric acid esters and salts thereof.

Further suitable components (a) are monoalkylated polyethylene glycol ethers, such as, for example, ethylene glycol monomethyl ether, diethylene glycol monomethyl ether, triethylene glycol monomethyl ether, ethylene glycol monobutyl ether, diethylene glycol monobutyl ether and triethylene glycol monobutyl ether and also dialkylated polyethylene glycol ethers, such as, for example, ethylene glycol dimethyl ether, diethylene glycol dimethyl ether, triethylene glycol dimethyl ether, ethylene glycol dibutyl ether, diethylene glycol dibutyl ether and triethylene glycol dibutyl ether.

In process step (a), preference is given to the use of a monoalkylated polyethylene glycol ether or a fatty alcohol polyglycol ether.

Surfactants to which special preference is given are triethylene glycol monobutyl ether and the phosphoric acid ester (potassium salt) of ethoxylated tridecyl alcohol.

In addition to containing one or more surfactants, the washing liquor used in process step (a) may include further textile auxiliaries, such as, for example, desizing agents, bleaching agents, wetting agents, enzymes, stabilisers, complexing agents, dispersants, anti-foams and pH regulators.

Process step (a) is advantageously carried out at slightly elevated temperature, preferably at from 30 to 60° C., especially at from 35 to 50° C.

The pH value of the pre-treatment bath is preferably adjusted to a range of from 2.5 to 6.5, especially from 3.0 to 6.0, using suitable buffer systems.

The application of the dye or dyes to the fibre materials in process step (b) is generally carried out by the exhaust method from aqueous dispersion in the presence of customary anionic or non-ionic dispersants and, optionally, customary swelling agents (carriers), at temperatures of from 100 to 160° C., preferably from 120 to 150° C.

In principle, any disperse dye known for dyeing polyester can be used in the process according to the invention.

The following disperse dyes are preferred: C.I. Disperse Yellow 114, C.I. Disperse Yellow 211, C.I. Disperse Yellow 54, C.I. Disperse Orange 25, C.I. Disperse Orange 30, C.I. Disperse Orange 31, C.I. Disperse Orange 44, C.I. Disperse Orange 61, C.I. Disperse Red 50, C.I. Disperse Red 73, C.I. Disperse Red 82, C.I. Disperse Red 167, C.I. Disperse Red 324, C.I. Disperse Red 356, C.I. Disperse Red 376, C.I. Disperse Red 382, C.I. Disperse Red 383, C.I. Disperse Violet 93:1, C.I. Disperse Violet 107, C.I. Disperse Blue 56, C.I. Disperse Blue 60, C.I. Disperse Blue 79:1, C.I. Disperse Blue 93:1, C.I. Disperse Blue 165, C.I. Disperse Blue 284, C.I. Disperse Blue 291 and C.I. Disperse Blue 354.

The dyes can be applied individually or in mixtures.

Advantageously, mixtures of two or three dyes (di- or tri-chromicity) may be used. Mixtures of four or more dyes, however, can also be used, especially in the production of grey shades.

The amounts in which the individual dyes are used in the dye baths can vary within wide limits depending on the desired depth of shade. In general, amounts of from 0.01 to 35% by weight, especially from 0.1 to 15% by weight, based on the fibre material to be dyed have proved to be advantageous.

The liquor ratio can be selected from within a wide range, for example within a range of from 1:2 to 1:50, preferably from 1:3 to 1:15.

Process step (b) is carried out preferably at from pH 3.0 to 5.5, especially from pH 3.5 to 5.0.

The reducing agents for use in the after-treatment step (c) are α-hydroxyalkylsulfinic acids or salts thereof, preferably sodium salts thereof.

The following are examples of suitable hydroxysulfinic acids: hydroxymethylsulfinic acid, 1-hydroxyethylsulfinic acid, 1-hydroxypropylsulfinic acid, 1-hydroxybutylsulfinic acid, 1-hydroxy-1-methylethylsulfinic acid, 1-hydroxy-1-ethylpropylsulfinic acid, 1-hydroxy-1-methylpropylsulfinic acid and 1-hydroxy-1-methylpentylsulfinic acid.

Reducing agents to which preference is given are hydroxymethylsulfinic acid and salts of hydroxymethylsulfinic acid, especially sodium hydroxymethylsulfinate.

Since, unlike most other customary reducing agents, α-hydroxyalkylsulfinic acids can also be used in the acid pH range, the pH in process step (c) of the process according to the invention is preferably set in the range from 3.5 to 6.5, especially in the range from 4.0 to 6.0.

Advantageously, process step (c) is carried out at from 50 to 100° C., preferably at from 60 to 90° C.

An important advantage of the process according to the invention is that all three process steps (a), (b) and (c) can be carried out in the acid pH range, preferably at pH values of from 2.5 to 6.5.

In the process according to the invention, cellulose fibres (for example cotton) simultaneously present in the dye bath do not take up colour or take up colour only slightly (very good reserve), so that the process is also well suited to dyeing polyester/cellulose fibre blend fabrics.

The process according to the invention is advantageously suitable also for dyeing or printing microfibres of synthetic polyesters. Microfibres are understood to mean fibre materials that are made up of threads having an individual fineness of less than 1 denier (1.1 dTex). Such microfibres are known and are usually produced by melt-spinning.

The said textile material can be in a very wide variety of processing forms, for example in the form of fibres, yarn, woven fabrics or knitted fabrics and in the form of carpets.

Dyeings having good allround fastness properties, such as, for example, good fastness to chlorine, to rubbing, to wetting, to wet rubbing, to washing, to water, to sea water and to perspiration, are obtained. The washing fastness properties, especially, have very good values.

It is possible, by means of the "all-in-one" process according to the invention, for the total duration of pre-treatment, dyeing and reductive after-treatment, which in the conventional PES dyeing procedure is approximately from 200 to 240 min., to be reduced to approximately from 70 to 150 min.

Since the process according to the invention requires just a single washing operation after the process step, the amount of water used in the procedure as a whole is approximately 50% lower than in the conventional process.

An energy saving of about 40% is also achieved.

The following Examples serve to illustrate the invention. Unless otherwise indicated therein, parts are parts by weight and percentages are percentages by weight. Temperatures are given in degrees Celsius. The relationship between parts by weight and parts by volume is the same as that between grams and cubic centimetres.

EXAMPLE 1

2.0 kg of a PES microfibre fabric (0.8 d) are immersed in a liquor, heated to 40° C., that contains

- 2 g/l of washing solution (15% triethylene glycol butyl ether, 12% potassium phosphate salt of ethoxylated tridecyl alcohol, 10% Marlowet® OFA (surfactant, marketed by Sasol) and 63% water);
- 1 g/l Univadine® DPL (dispersant, Ciba Specialty Chemicals);
- 1 g/l Cibaflow® UNI (anti-foam, Ciba Specialty Chemicals);
- 1 g/l Cibatex® AB45 (acid buffer, Ciba Specialty Chemicals).

After 5 min., the disperse dyes Terasil® Orange SD (Ciba Specialty Chemicals), Terasil® Rubine SD (Ciba Specialty Chemicals) and Terasil® Dark Blue SD (Ciba Specialty Chemicals) are added in such amounts that their concentrations in the liquor are 1.3% (Terasil® Orange SD), 3.0% (Terasil® Rubine SD) and 0.2% (Terasil® Dark Blue SD). The liquor is then heated at a rate of 2° C./min. to 130° C. After 40 min. at 130° C., the liquor is cooled at a rate of 2.5° C./min. to 80° C. 2 g/l of a reducing agent (24.9% hydroxymethanesulfinic acid/sodium salt, 0.2% Proxel GXL (preservative, Avecia Inc.), 74.9% water) are then added; the pH is about 5. After 20 min. at 80° C., the dyeing obtained is washed with water and dried. A dark-red dyeing having good allround fastness properties, especially a high degree of fastness to light and to washing, is obtained.

The fastness to washing values measured according to ISO 105 C01 are given in Table 1.

EXAMPLE 2

2.070 kg of a PES microfibre fabric (0.8 d) are dyed with Terasil® Orange SD, Terasil® Rubine SD and Terasil® Dark Blue SD in the manner described in Example 1. The dyes are added in such amounts that their concentrations in the liquor are 0.8% (Terasil® Orange SD), 0.3% (Terasil® Rubine SD)

and 2.4% (Terasil® Dark Blue SD). The total duration of the wet procedure is 135 min. A dark-blue dyeing having good allround fastness properties, especially a high degree of fastness to light and to washing, is obtained.

The fastness to washing values measured according to ISO 105 C01 are given in Table 1.

EXAMPLE 3

2.780 kg of a PES microfibre fabric (0.8 d) are dyed with Terasil® Orange SD, Terasil® Rubine SD and Terasil® Dark Blue SD in the manner described in Example 1. The dyes are added in such amounts that their concentrations in the liquor are 0.73% (Terasil® Orange SD), 0.048% (Terasile Rubine SD) and 0.5% (Terasil® Dark Blue SD). Cibatex® AB-45 is introduced in an amount of 2 g/l; the heating rate is 3° C./min. After 20 min. at 130° C., the liquor is cooled at a rate of 5° C./min. to 80° C. The total duration of the wet procedure is 90 min. A grey dyeing having good allround fastness properties, especially a high degree of fastness to light and to washing, is obtained.

The fastness to washing values measured according to ISO 105 C01 are given in Table 1.

TABLE 1

Fastness to washing according to ISO 105 C01 (40° C. × 30 min.)

| Example | CA | CO | PA | PES | PAN | WO |
|---|---|---|---|---|---|---|
| 1 | 3-4 | 4-5 | 3-4 | 4 | 4-5 | 4-5 |
| 2 | 4-5 | 4-5 | 4-5 | 4-5 | 5 | 5 |
| 3 | 4-5 | 4-5 | 4-5 | 4-5 | 5 | 5 |

What is claimed is:

1. A process for dyeing polyester fibre material according to the exhaust method, which process comprises the following steps:

(a) pre-treatment of the fibre material with triethylene glycol monobutyl ether or phosphoric acid ester (potassium salt) of ethoxylated tridecyl alcohol or a mixture thereof, (b) dyeing with one or more disperse dyes, and (c) reductive after-treatment with a hydroxyalkylsulfinic acid or a hydroxyalkylsulfinic acid salt, wherein steps (a), (b) and (c) are carried out in succession in a single liquor.

2. A process according to claim 1, wherein one or more dyes used in process step (b): are selected from the group consisting of C.I. Disperse Yellow 114, C.I. Disperse Yellow 211, C.I. Disperse Yellow 54, C.I. Disperse Orange 25, C.I. Disperse Orange 30, C.I. Disperse Orange 31, C.I. Disperse Orange 44, C.I. Disperse Orange 61, C.I. Disperse Red 50, C.I. Disperse Red 73, C.I. Disperse Red 82, C.I. Disperse Red 167, C.I. Disperse Red 324, C.I. Disperse Red 356, C.I. Disperse Red 376, C.I. Disperse Red 382, C.I. Disperse Red 383, C.I. Disperse Violet 93:1, C.I. Disperse Violet 107, C.I. Disperse Blue 56, C.I. Disperse Blue 60, C.I. Disperse Blue 79:1, C.I. Disperse Blue 93:1, C.I. Disperse Blue 165, C.I. Disperse Blue 284, C.I. Disperse Blue and, C.I. Disperse Blue 354.

3. A process according to claim 1, wherein hydroxymethylsulfinic acid or a salt of hydroxymethylsulfinic acid is used in process step (c).

4. A process according to claim 1, wherein in all three process steps (a), (b) and (c) the pH value of the liquor is from 2.5 to 6.5.

5. A process according to claim 1, wherein the polyester fibre material consists of pure polyester or of polyester/cellulose blend fabric.

6. A process according to claim 5, wherein the polyester fibre material consists of microfibres.

* * * * *